US006453554B1

(12) United States Patent
Fukushima et al.

(10) Patent No.: US 6,453,554 B1
(45) Date of Patent: Sep. 24, 2002

(54) SWASH PLATE TYPE COMPRESSOR PISTON WHEREIN INNER SURFACE OF BASE SECTION OF NECK PORTION HAS AS-CAST SURFACE AREA

(75) Inventors: Shigeo Fukushima; Takayuki Kato; Masato Takamatsu; Takahiro Hoshida, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/645,000

(22) Filed: Aug. 24, 2000

(30) Foreign Application Priority Data

Aug. 26, 1999 (JP) ..... 11-239364

(51) Int. Cl.[7] ..... B23P 15/00

(52) U.S. Cl. ..... 29/888.042; 29/888.04; 92/71

(58) Field of Search ..... 92/71; 29/888.04, 29/888.042

(56) References Cited

U.S. PATENT DOCUMENTS 4,519,119 A * 5/1985 Nakayama et al. ..... 92/212 X
5,318,091 A * 6/1994 Pavoni et al. ..... 164/6
5,960,542 A * 10/1999 Umemura et al. ..... 29/888.042
6,146,110 A * 11/2000 Higashihara et al. .. 29/888.042
6,189,434 B1 * 2/2001 Kawaguchi et al. ..... 92/71

FOREIGN PATENT DOCUMENTS

JP 9-203378 8/1997
JP 9-256952 9/1997

* cited by examiner

*Primary Examiner*—Kevin Lee
(74) *Attorney, Agent, or Firm*—Woodcock Washburn LLP

(57) ABSTRACT

A die-cast piston for a swash plate type compressor including a cylinder block having a cylinder bore, including a generally cylindrical head portion slidably movably received in a cylinder bore formed in a cylinder block of the compressor, and a generally U-shaped neck portion having a base section and a pair of substantially parallel arm sections which extend from the base section, wherein the base section has an inner surface including at least one as-cast surface area formed in a die-casting process.

15 Claims, 6 Drawing Sheets

SWASH PLATE TYPE COMPRESSOR PISTON WHEREIN INNER SURFACE OF BASE SECTION OF NECK PORTION HAS AS-CAST SURFACE AREA

This application is based on Japanese Patent Application No. 11-239364 filed Aug. 26, 1999, the contents of which are incorporated hereinto by reference.

BACKGROUND OF THE INVENTION

1. Field of the Invention

The present invention relates in general to a piston for a swash plate type compressor, and more particularly to a die-cast piston for such a compressor, and a method of producing such a piston by die-casting.

2. Discussion of Related Art

A piston for a swash plate type compressor is conventionally produced by forging or die-casting. Described more specifically, a blank for the piston is formed by forging or die-casting, and the blank is subjected to appropriate machining operations, to produce the desired piston. The swash plate type compressor piston may be a single-headed piston or a double-headed piston. The single-headed piston includes a head portion and a neck portion which are slidably movable in a cylinder bore formed in a cylinder block of the compressor. The neck portion is a generally U-shaped portion having a base section and a pair of substantially parallel arm sections which extend from the base section. The double-headed piston includes two head portions on the opposite sides of the neck portion. Since the single- or double-headed piston is reciprocated within the cylinder bore, it is generally required to reduce the weight of the piston. For this reason, there has been proposed a piston formed of an aluminum alloy and designed to have a wall thickness as small as possible. On the other hand, the base section of the neck portion of the piston is subject to repeated application of a bending moment during a reciprocating movement of the piston. To assure the intended durability of the piston, therefore, the reduction of the wall thickness is limited. While the piston produced from a forged blank has a comparatively high degree of strength, the piston by produced by die-casing inevitably has a lower strength.

SUMMARY OF THE INVENTION

It is therefore a first object of the present invention to provide a die-cast piston for a swash plate type compressor, which piston has a sufficiently high degree of durability while having a reduced weight. A second object if the invention is to provide a method of producing such a lightweight, highly durable die-cast piston.

The first or second object may be achieved according to any one of the following modes of the present invention, each of which is numbered like the appended claims and depends from the other mode or modes, where appropriate, to indicate and clarify possible combinations of elements or technical features. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) A die-cast piston for a swash plate type compressor including a cylinder block having a cylinder bore formed therein, the piston comprising a generally cylindrical head portion slidably movably received in the cylinder bore, and generally U-shaped neck portion having a base section and a pair of substantially parallel arm sections which extend from the base section, the die-cast piston being characterized in that the base section has an inner surface including at least one as-cast surface area formed in a die-casting process.

In the die-cast piston constructed according to the above mode (1) of this invention wherein the inner surface of the base section of the neck portion includes an as-cast surface area or areas, the base section has an increased degree of durability or strength. Generally, a die-cast article or product has a chilled layer adjacent to its surface, and the chilled layer left unmachined after the die casting process is effective to improve the strength of the die-cast article. The chilled layer is formed by rapid cooling and solidification of a molten mass of iron in a casting mold, at a portion of the molten mass in contact with the inner surface of the mold which defines a mold cavity. The chilled layer is characterized by a discontinuous change in the crystallization ratio of the primary crystal or $\alpha$-phase (proeutectic) and the eutectic silicon with respect to each other. Since the chilled layer has high values of hardness and strength, the presence of the chilled layer adjacent to the inner surface of the base section of the neck portion is effective to increase the bending strength of the base section, particularly, the durability of the base section. The inner surface of the base section, which is located close to the outer circumferential surface of the swash plate of the compressor, is conventionally subjected to a machining operation, which results in the removal of the chilled layer. In the piston according to the present invention, however, the chilled layer adjacent to at least a portion of the inner surface of the base section is left unmachined, so as to provide at least one as-cast surface area, so that, like a forged piston, the present die-cast piston has sufficiently high degrees of durability and strength owing to the chilled layer while having a significantly reduced weight. Although the inner surface of the base section is preferably left as-cast over a surface area as large as possible, the inner surface may be required to be more or less machined at some area, for the purpose of removing a rib or casting fins. A die-cast blank that is subjected to machining and other working operations to produce the piston is usually provided with a reinforcing rib or ribs to assure accurate and efficient machining of the blank. The casing fins are inevitably formed on the blank, at a parting plane of the mold at which the mold halves are butted together to define the mold cavity. Where the inner surface of the base section is partially machined, the surface area to be machined is desirably minimized to maximize the total as-cast surface area for maximizing the durability and strength of the base section of the neck portion.

(2) A die-cast piston according to the above mode (1), wherein the inner surface includes a central machined surface area and a pair of as-cast surface areas, the central machined surface area being located at an intermediate portion of the inner surface as viewed in a direction perpendicular to a centerline of the piston which passes a center of the generally cylindrical head portion, the central machined surface area being formed as a result of a machining operation in the intermediate portion of the inner surface, and wherein the pair of as-cast surface areas are located on opposite sides of the central machined surface area as viewed in the direction.

The die-cast blank which is processed to produce the die-cast piston is generally provided with reinforcing rib or ribs for the purpose of preventing thermal strains of the blank during heat treatment thereof and reducing elastic deformation during machining operations on the blank. For instance, a rib is formed so as to extend between a pair of arm sections which extend from a base section of a neck portion of the blank in a direction perpendicular to the centerline of the blank which passes the center of the head portion, so that the rib connects the base section and the two arm sections. The rib is formed so as to extend from a central portion of the inner surface of the base section, which central portion is located an intermediate portion of the inner surface as viewed in the direction perpendicular to the centerline. The rib is eventually removed by a machining operation, so that the die-cast piston does not have the rib. Accordingly, the central portion of the inner surface of the base section of the blank must be subjected to a machining operation to remove the rib, so that the inner surface of the base section inevitably has a central machined surface area. In other words, the inner surface of the base section of the piston can have a pair of as-caset surface areas on the opposite sides of the central machine surface area as viewed in the direction in which the arm sections extend. The as-cast surface areas left on the inner surface of the base section are effective to increase the neck portion of the piston.

(3) A die-cast piston according to the above mode (1), wherein a substantially entire portion of the inner surface is an as-cast surface area.

The piston according to the above mode (3) is most preferred from the standpoint of the durability of the neck portion.

(4) A die-cast piston according to any one of the above modes (1)-(3), wherein the pair of arm sections have opposed inner surfaces having as-cast surface areas adjacent to the at least one as-cast surface area of the base section, the as-cast areas of the arm sections being also formed in the die-casting process.

The opposed inner surfaces if the pair of arm sections are usually machined to be flat surfaces in which part-spherical recesses are formed by machining so that part-spherical shoes are partially received in the respective recesses, for sliding contact with the opposite surfaces of the swash plate of the compressor. For increasing the durability of the neck portion, the opposed inner surfaces of the arm sections preferably remain as-cast, particularly, at the end portions of the opposed inner surfaces adjacent to the end portions of the inner surface of the base section. Generally, there are provided fillets of a small radius of curvature at the boundaries of the inner surface of the base section and the opposed inner surfaces of the arm sections, in order to reduce the stress concentration at those boundaries. For increasing the durability of the neck portion, the fillets are preferably left as-cast, namely, preferably have as-cast surfaces.

(5) A die-cast piston according to any one of the above modes (1)-(4), wherein the head portion includes a body section having a circular shape in transverse cross section and cooperating with the cylinder bore of the compressor to partially define a pressurizing chamber, the piston further comprising a connecting portion which connects the head portion and the neck portion.

The configuration of the die-cast piston according to the above mode (5) is desirable for facilitating the removal of the blank from the casting mold. Usually, the casting mold consists of two mold halves which are butted together so as to define a parting plane which includes the centerline of the head portion having the circular body section and which is parallel to the direction of extension of the arm sections from the base section. Where the rib indicated above is not formed so as to extend from the intermediate or central portion of the inner surface of the base section, the casting fins are likely to be formed on this central portion due to the abutting contact of the two mold halves at the parting line indicated above. In this case wherein the rib is not formed, the central portion is preferably subjected to a machining operation to remove the fins. As in the case wherein the inner surface of the base section is machined to remove the rib, the machined surface area is desirably minimized to maximize the as-cast surface area, in the case where the inner surface of the base section is defined.

(6) A die-cast piston according to the above mode (5), wherein the head portion further includes a sliding section extending from the body section and connecting the body section and the connecting portion.

The sliding section provided between the circular body section of the head portion and the connecting portion is effective to assure smooth sliding movement of the piston within the cylinder bore, without an inclination of the centerline with respect to the centerline of the cylinder bore. However, the sliding section desirably has a relatively small weight to reduce the overall weight of the piston. To reduce the weight of the sliding section, the sliding section preferably consists of a radially outer sliding section and a radially inner sliding section which correspond to radially outer and inner portions of the cylinder block.

(7) A method of producing a die-cast piston for a swash plate type compressor including a cylinder block having a cylinder bore formed therein, the die-cast piston comprising a generally cylindrical head portion slidably movably received in the cylinder bore, and a generally U-shaped neck portion having a base section and a pair of substantially parallel arm sections which extend from the base section, the method comprising the steps of:

forming a blank by die casting such that the blank includes: a head portion which gives the head portion of the piston; a neck portion which gives the neck portion of the piston and which includes a base section and a pair of arm sections; and a reinforcing portion which extends so as to connect the pair of arm sections of the neck portion of the blank, in a direction parallel to a centerline of the blank which passes a center of the head portion of the blank; and subjecting the blank to a machining operation to remove the reinforcing portion such that the base section of the neck portion of the blank has an inner surface including at least one as-cast surface area which is left unmachined.

Conventionally, the inner surface of the base section of the neck portion of the blank which give the inner surface of the base section of the neck portion of the piston is machined upon removal of the reinforcing portion. In the method according to the above mode (7) of the present invention, the area of the inner surface of the blank to be machined is minimized to maximize the as-cast surface area, for the purpose of maximizing the durability and strength of the neck portion of the piston produced by processing the blank.

(8) A method according to the above mode (7), wherein the reinforcing portion is a rib extending from a central portion of the inner surface of the base section of the blank in a direction of extension of the pair of arm sections of the blank, the central portion being located at an intermediate portion of the inner surface of the base section of the blank as viewed in a direction perpendicular to the centerline, the rib connecting the base section and pair of arm sections of the blank, and wherein the step of subjecting the blank to a machining operation comprises removing the rib such that the inner surface of the base section of the blank includes a central machined surface area and a pair of as-cast surface areas located on the opposite sides of the central machined surface area as viewed in the direction perpendicular to the centerline.

In the method according to the above mode (8), the central portion of the inner surface of the base section of the neck portion of the blank is removed when the rib is removed by the machining operation. However, there are left as-cast surface areas in the portions of the inner surface located on the opposite sides of the central machine surface area formed by the removal of the rib. These as-cast surface areas are effective to increase the durability of the neck portion of the piston produced from the blank.

(9) A method according to the above mode (7), wherein the reinforcing portion is a bridge portion extending to connect the pair of arm sections of the blank in the direction parallel to the centerline, the bridge portion being spaced apart from the inner surface of the base section of the blank, and wherein the subjecting central portion being located at an intermediate portion of the inner surface of the base section of the blank as viewed in a direction perpendicular to the centerline, and wherein the step of subjecting the blank to a machining operation comprises removing the bridge portion and machining a central portion of the inner surface of the base section of the blank to remove fins formed in the step of forming a blank, such that the inner surface of the base section of aid blank includes a central machined surface area and a pair of as-cast surface areas located on the opposite sides of the central machined surface area as viewed in the direction perpendicular to the centerline.

In the method according to the above mode (9), the fins formed along the parting plane of the mold halves are removed by machining the central portion of the inner surface of the base section of the neck section of the blank, such that the portions on the opposite sides of the central machined surface area are left as as-cast surface areas, which improve the durability of the neck portion of the piston produced by processing the blank.

(10) A method according to any one of the above modes (7)-(9), wherein the step of subjecting the blank to a machining operation comprises:

positioning a rotary cutting tool having a peripheral cutting edge such that the rotary cutting tool is rotatable about an axis which is parallel to the centerline and which is aligned with a center of the reinforcing portion as viewed in the direction perpendicular to the centerline;

feeding the rotary cutting tool in a radial direction thereof toward the inner surface of the base section of the neck portion of the blank while the rotary cutting tool is rotated, so that the reinforcing portion extending between the pair of arm sections of the blank is removed.

In the method according to the above mode (10) wherein the rotary cutting tool is used to remove the reinforcing portion, the portions of the inner surface of the base section of the neck portion of the blank located on the opposite sides of the central machined area can be easily left as the as-cast surface areas.

(11) A method according to any one of the above modes (7)-(10), wherein the pair of arm sections of the neck portion of the blank have respective opposed inner surfaces which are opposed to each other in the direction parallel to the centerline, and the rotary cutting edge further has side cutting edges formed on opposite sides of the peripheral cutting edge, and wherein the machining operation comprises machining at least a portion of each of the opposed inner surfaces such that an end portion of the each of the opposed inner surfaces which is adjacent to the inner surface of the base section of the blank is left as an as-cast surface area.

In the method according to the above mode (11) wherein the machining operation is performed by the rotary cutting tool having both the peripheral cutting edge and the side cutting edges, not only the central portion of the inner surface of the base section of the blank but also portions of the opposed inner surfaces of the pair of arm sections are removed by the same rotary cutting tool. To produce the piston, two recesses are formed in the above-indicated machined portions of the opposed inner surfaces of the arm sections, so that shoes are partially received in the recesses, for sliding contact with the opposite surfaces of the swash plate of the compressor. The machining operation on the opposed inner surfaces is performed such that the end portions of the opposed inner surfaces adjacent to the inner surface of the base section are left as cast, in order to reduce the stress concentration at the boundaries between the inner surface of the base section and the opposed inner surfaces of the arm sections, which stress concentration would easily take place in the absence of the as-cast surfaces at those boundaries. Thus, the durability of the piston produced from the blank is further increased according to the above mode (11) of this invention.

BRIEF DESCRIPTION OF THE INVENTION

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1:
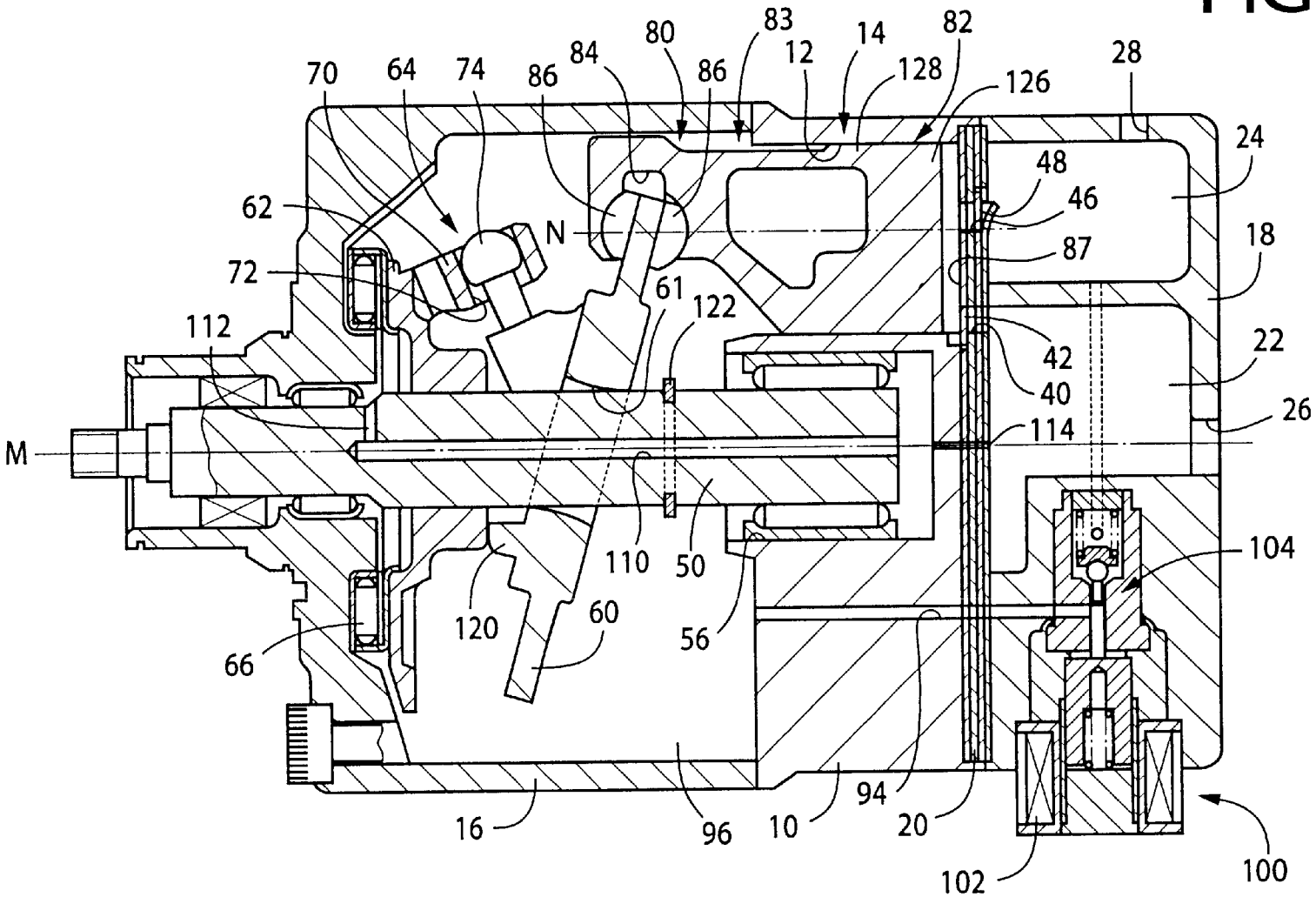
FIG. 1 is a front elevational view in cross section of a swash plate type compressor incorporating a die-cast piston produced by a method according to one embodiment of this invention.

Referring first to FIG. 1, there is shown a compressor of swash plate type incorporating a plurality of single-headed pistons each constructed and produced according to one embodiment of this invention.

In FIG. 1, reference numeral 10 denotes a cylinder block having a centerline M and a plurality of cylinder bores 12 formed so as to extend in its axial direction such that the cylinder bores 12 are arranged along a circle whose center lies on the centerline M. A single-headed piston generally indicated at 14 (hereinafter referred to as "piston 14") is reciprocably received in each of the cylinder bores 12. To one of the axially opposite end faces (the left end face as seen in FIG. 1, witch will be referred to as "front end face") of the cylinder block 10, there is attached a front housing 16. To the other end face (the right end face as seen in FIG. 1, which will be referred to as "rear end face"), there is attached a rear housing 18 through a valve plate structure 20. The front housing 16, rear housing 18 and cylinder block 10 cooperate to constitute a major portion of the housing assembly of the swash plate type compressor.

The rear housing 18 and the valve plate structure 20 cooperate to define a suction chamber 22 and a discharge chamber 24, which are connected to a refrigerating circuit (not shown) through an inlet 26 and an outlet 28, respectively. The valve plate structure 20 has suction ports 40, suction valves 42, discharge ports 44 and discharge valves 48.

A rotary drive shaft 50 is disposed in the cylinder block 10 and the front housing 16 such that the axis of rotation of the drive shaft 50 is aligned with the centerline M of the cylinder block 10. The drive shaft 50 is supported at its opposite end portions by the front housing 16 and the cylinder block 10 via respective bearings. The cylinder block 10 has a central bearing hole 56 in a central portion thereof, and the bearing is disposed in this central bearing hole 56, for supporting the drive shaft 50 at its rear end portion.

The front end portion of the rotary drive shaft 50 extends through a central portion of the front housing 16, such that the front end of the drive shaft 50 is located outside the front housing 16, so that the drive shaft 50 is connected at its front end to a drive power source (not shown). The drive shaft 50 carries a swash plate 60 mounted thereon such that the swash plate 60 is axially movable and tiltable relative to the drive shaft 50. The swash plate 60 has a center hole 61 through which the driveshaft 50 extends. The diameter of the center hole 61 gradually increases in the opposite axial directions from its axially intermediate portion towards the axially opposite ends. To the drive shaft 50, there is fixed a lug plate 62 which is held in engagement with the swash plate 60 through a hinge mechanism 64. The lug plate 62 is rotatable with the drive shaft 50 relative to the front housing 16 through a thrust bearing 66. The hinge mechanism 64 causes the swash plate 60 to be rotated with the drive shaft 50 during rotation of the drive shaft 50, and permits axial and tilting motions of the swash plate 60. In this respect, it is noted that the diameter of the center hole 61 at its opposite axial ends is larger than the outside diameter of the drive shaft 50.

The hinge mechanism 64 includes a pair of support arms 70 fixed to the lug plate 62, and guide pins 74 formed on the swash plate 60. The guide pins 74 slidably engage guide holes 72 formed in the support arms 70.

The piston 14 indicated above includes a neck portion 80 engaging the swash plate 60, a generally cylindrical head portion 82 fitted in the corresponding cylinder bore 12, and a connecting portion 83 connecting the neck portion 80 and the head portion 82. The neck portion 80 has a groove 84 formed therein, and the swash plate 60 is held in engagement with the groove 84 through a pair of hemispherical shoes 86. The hemi-spherical shoes 86 are held in the groove 84 such that the shoes 86 slidably engage the neck portion 80 at their hemi-spherical surfaces, and slidably engage the opposite surfaces of the swash plate 60 at their flat surfaces. It will be understood that the head portion 82 cooperates with the cylinder block 10 and the valve plate structure 20 to define a pressurizing chamber 87. The configuration of the piston 14 will be described in detail.

A rotary motion of the swash plate 60 is converted into a reciprocating linear motion of the piston 14 through the shoes 86. A refrigerant gas in the suction chamber 22 is sucked or admitted into the pressurizing chamber 87 through the suction port 40 and the suction valve 42, when the piston 14 is moved from its upper dead point to its lower dead point, that is, when the piston 14 is in the suction stroke. The refrigerant in the pressurizing chamber 87 is pressurized by the piston 14 when the piston 14 is moved from its lower dead point to its upper dead point, that is, when the piston 14 is in the compression stroke. The thus pressurized refrigerant gas is delivered into the discharge chamber 24 through the discharge port 46 and the discharge valve 48. A reaction force acts on the piston 14 in the axial direction as a result of compression of the refrigerant gas in the pressurizing chamber 87. This compression reaction force is received by the front housing 16 through the piston 14, swash plate 60, lug plate 62 and thrust bearing 66.

Figure 2:
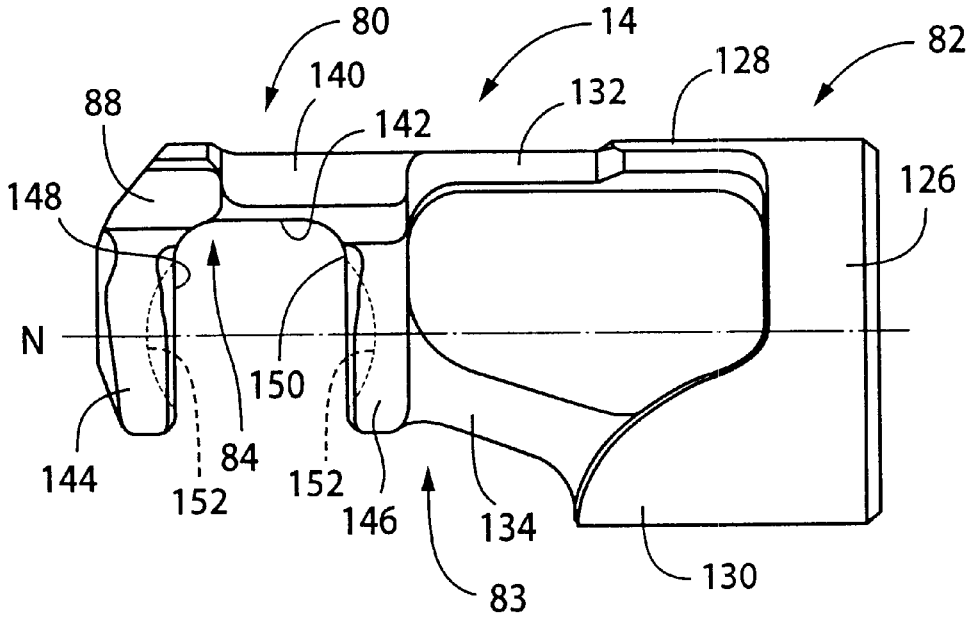
FIG. 2 is a front elevational view of the die-cast piston of the compressor of FIG. 1.

As shown in FIG. 2, the neck portion 80 of the piston 14 has an integrally formed rotation preventive part 88, which is arranged to contact the inner circumferential surface of the front housing 16, for thereby preventing a rotary motion of the piston 14 about its centerline N (FIG. 1).

The cylinder block 10 has a supply passage 94 formed therethrough for communication between the discharge chamber 24 and a crank chamber 96 which is defined between the front housing 16 and the cylinder block 10. The supply passage 94 is connected to a solenoid-operated control valve 100 provided to control the pressure in the crank chamber 96. The solenoid-operated control valve 100 includes a solenoid coil 102, and a shut-off valve 104 which is selectively closed and opened by energization and de-energization of the solenoid coil 120. Namely, the shut-off valve 104 is placed in its closed state when the solenoid coil 102 is energized, and is placed in its open state when the coil 102 is de-energized.

The rotary drive shaft 50 has a bleeding passage 110 formed therethrough. The bleeding passage 110 is open at one of its opposite ends to the central bearing hole 56 indicated above, and is open to the crank chamber 96 through a communication passage 112. The central bearing hole 56 communicates at its bottom with the suction chamber 22 through a communication port 114.

When the solenoid coil 102 of the solenoid-operated control valve 100 is energized, the supply passage 94 is closed, so that the pressurized refrigerant gas in the discharge chamber 24 is not delivered into the crank chamber 96. In this condition, the refrigerant gas in the crank chamber 96 flows into the suction chamber 22 through the bleeding passage 110 and the communication port 114, so that the pressure in the crank chamber 96 is lowered. As a result, the angle of inclination of the swash plate 60 with respect to a plane perpendicular to the axis of rotation M of the drive shaft 50 is increased, and the discharge capacity of the compressor is accordingly increased.

When the solenoid coil 102 is de-energized, the supply passage 94 is opened, permitting the pressurized refrigerant gas to be delivered from the discharge chamber 24 into the crank chamber 96, resulting in an increase in the pressure in the crank chamber 96, and the angle of inclination of the swash plate 60 is reduced, so that the discharge capacity of the compressor is accordingly reduced.

The maximum angle of inclination of the swash plate 60 is limited by abutting contact of a stop 120 formed on the swash plate 60, with the lug plate 62, and the minimum angle of inclination of the swash plate 60 is limited by abutting contact of the swash plate 60 with a stop 122 in the form of a ring fixedly fitted on the drive shaft 50.

As described above, the pressure in the crank chamber 96 is controlled by controlling the solenoid-operated control valve 100 to selectively connect and disconnect the crank chamber 96 to and from the discharge chamber 24. The angle of inclination of the swash plate 60 is changed with a change in the pressure in the crank chamber 96, so that the stroke of the piston 14 is controlled to control the discharge capacity of the compressor. Thus, the swash plate type compressor having the piston 14 in each cylinder bore 12 is of a variable capacity type. The solenoid coil 102 of the solenoid-operated control valve 100 is controlled by a control device (not shown) depending upon a load acting on the air conditioning system including the present compressor. The control device is principally constituted by a computer.

The cylinder block 10 and each piston 14 are formed of an aluminum alloy. The piston 14 is coated at its outer circumferential surface with a fluoro resin film, which prevents a direct contact of the aluminum alloy of the piston 14 with the aluminum alloy of the cylinder block 10, and makes it possible to minimize the amount of clearance between the piston 14 and the cylinder bore 12. The cylinder block 10 and the piston 14 may also be formed of a hyper-eutectic aluminum silicon alloy. Other materials may be used for the cylinder block 10 and the piston 14.

There will next be described the configuration of the piston 14.

As shown in FIG. 2, the head portion 82 of the piston 14 includes a body section 126, and an outer sliding section 128 and an inner sliding section 130 which correspond to respective radially outer and inner portions of the cylinder block 10. The radially outer portion of the cylinder block 10 is more distant from the centerline M than the radially inner portion of the cylinder block 10. The body section 126 has a circular shape in cross section. The outer and inner sliding sections 128, 130 extend towards the neck portion 80 from respective circumferential parts of the circular body section 126, which parts correspond to the radially outer and inner portions of the cylinder block 10. The outer and inner sliding sections 128, 130 are adapted to slid on the respective circumferential portions of the inner circumferential surface of the cylinder bore 12, which portions correspond to the radially outer and inner portions of the cylinder block 12.

The connecting portion 83 of the piston 14 consists of a radially outer section 132 connecting the radially outer sliding portion 128 and the neck portion 80, and a radially inner section 134 connecting the radially inner sliding portion 130 and the neck portion 80. The piston 14 consists of the head portion 82, neck portion 80 and connecting portion 83, which are formed integrally with each other.

The neck portion 80 of the piston 14 is a generally U-shaped portion as seen in FIG. 2, which includes a base section 140 having an surface 142, and a pair of side walls in the form of two parallel arm sections 144, 146 which extend from the base section 140 in a direction perpendicular to the centerline N of the piston 14 which passes the center of the cylindrical head portion 82. The arm section 144 is located at the end of the neck portion 80 remote from the head portion 82. The arm sections 144, 146 have respective inner surfaces 148, 150 which are opposed to each other in the direction of the centerline N and which cooperate with the inner surface 142 of the base section 140 to define the groove 84 indicated above. The neck portion 80 has a fillet formed at the boundary between each of the opposed inner surfaces 148, 150 of the arm sections 144, 146 and the inner surface 142 of the base section 140. The fillet has a comparatively small radius of curvature, so that the inner surface 142 is smoothly connected at its opposite ends to the opposed inner surfaces 148, 150. The inner surfaces 148, 150 have respective part-spherical recesses 152. The two part-spherical shoes 86 whose flat surfaces slidably engage the opposite surfaces of the swash plate 60 are held in contact at their part-spherical surfaces with the part-spherical surfaces of the respective part-spherical recesses 152.

Figure 3:
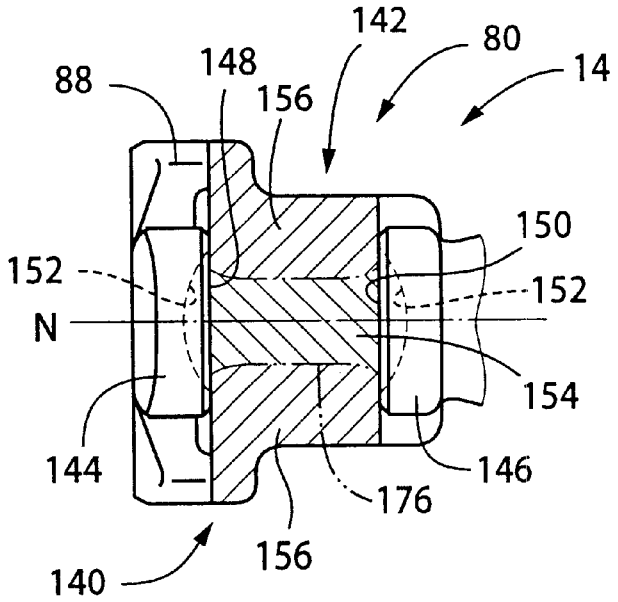
FIG. 3 is a plan view showing a part of the die-cast piston.

As shown in FIG. 3, the inner surface 142 of the base section 140 includes a central machined surface area 154 at an intermediate portion thereof as viewed in a direction perpendicular to the centerline N (as viewed in the direction perpendicular to the plane of view of FIG. 2). The machined surface area 154 is a generally elongate area (intermediate hatched area shown in FIG. 3) extending in the direction of the centerline N. The machined surface area 154 is formed by a machining operation, which will be described. On the opposite sides of the central machined surface area 154 as seen in FIG. 3, there are provided two as-cast surface areas 156 (two hatched areas shown in FIG. 3 on the opposite sides of the intermediate hatched area). The as-cast surface areas 156 are areas formed by die-casting to form a blank 160, which will be described. The curved surfaces of the fillets between the inner surface 142 of the base section 140 and the opposed surfaces 148, 150 of the arm sections 144, 146 are also as-cast surface areas.

Figure 4:
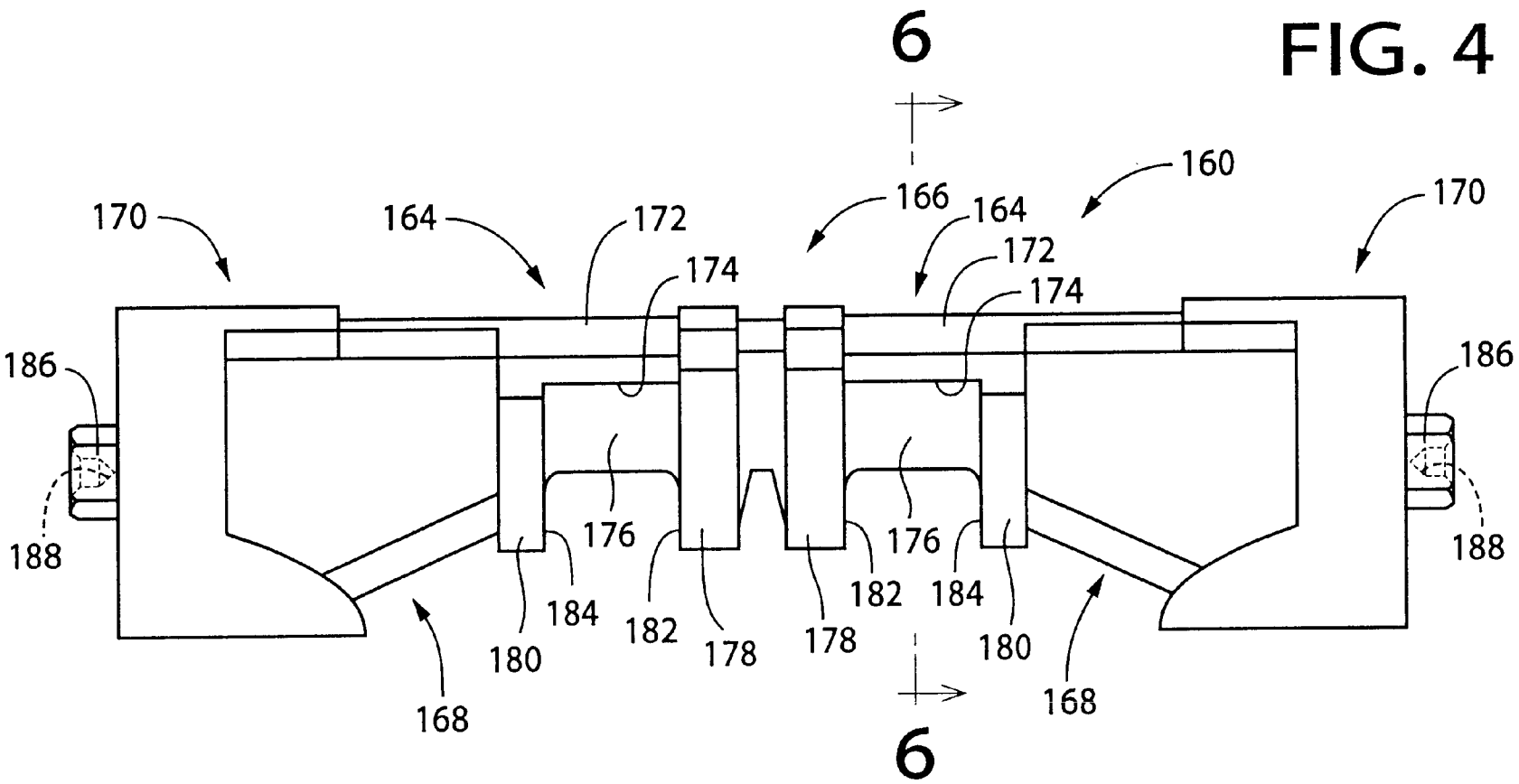
FIG. 4 is a front elevational view of a blank used for producing the die-cast piston of FIG. 1.

Two pieces of the single-headed piston 14 constructed as described above are produced from a single blank 160. As schematically shown in FIG. 4, the blank 160 consists of a single twin neck portion 166, two connecting portions 168 and two head portions 170, which are formed such that each of the two connecting portions 168 connects the centrally located twin neck portion 166 and the corresponding one of the two head portions 170 located at the opposite ends of the blank 160. The twin neck portion 166 consists of two neck portions 164 which are formed in series and integrally with each other and which provide respective two neck portions 80 of the two single-headed pistons 14. The two connecting portions 168 provide respective two connecting portions 83 of the two single-headed pistons 14, while the two head portions 170 provide respective two head portions 82 of the two single-headed pistons 14. Each of the two neck portions 164 of the twin neck portion 166 includes a base section 172 having an inner surface 174, a pair of opposed parallel arm sections 178, 180 extending from the opposite ends of the base section 172, and a reinforcing rib 176 which extends between the two arm sections 178, 180 in the longitudinal direction of the blank 160. The rib 176 extends also in the direction of extension of the base sections 172, from a central part of the inner surface 174 of the base section 172, which central part is central as seen in the direction perpendicular to the plane of view of FIG. 4. Thus, the rib 176 connects the inner surface 174 of the base section 172 and inner surfaces 182, 184 of the arm sections 178, 180, in order to reinforce the neck portion 164 for thereby increasing the rigidity and strength of the blank 160.

In the present embodiment, the blank 160 is formed of a metallic material, more precisely, an aluminum alloy, by diecasting using a suitable casting mold which consists of two halves. The two halves of the mold define a parting plane which includes a centerline of the blank 160 passing the centers of the generally cylindrical head portions 170 and which is parallel to the direction of extension of the arm sections 178, 180 from the base sections 172. This process of forming the blank 160 by die-casting is a die-casting step in a method of producing the piston 14. Following this die-casting step, a machining step is performed on the die-cast blank 160. The machining step includes cutting operations on a plurality of portions of the blank 160, which include the outer circumferential surfaces of the two head portions 170. To machine this outer circumferential surfaces, the head portions 170 have respective holding portions 186 extending from their end faces, as shown in FIG. 4. The holding portions 186 have respective center holes 188, so that the blank 160 is held at the holding portions 186 by respective chucks while the blank 160 is centered with a pair of centers which engage the respective center holes 188. To machine the outer circumferential surfaces of the head portions 170 on a suitable turning machine, the blank 160 is rotated by a suitable rotary drive device through the chucks. The integrally formed blank 160 the rigidity of which is increased by the ribs 176 can be efficiently and accurately machined.

Then, the machined outer circumferential surfaces of the head portions 170 and other selected surfaces of the blank 160 are coated with a suitable material, such as a film of polytetrafluoroethylene. Subsequently, the end faces of the head portions 170 are cut to remove the holding portions 186, and the coated outer circumferential surfaces of the head portions 170 are subjected to a centerless grinding operation.

Figure 5:
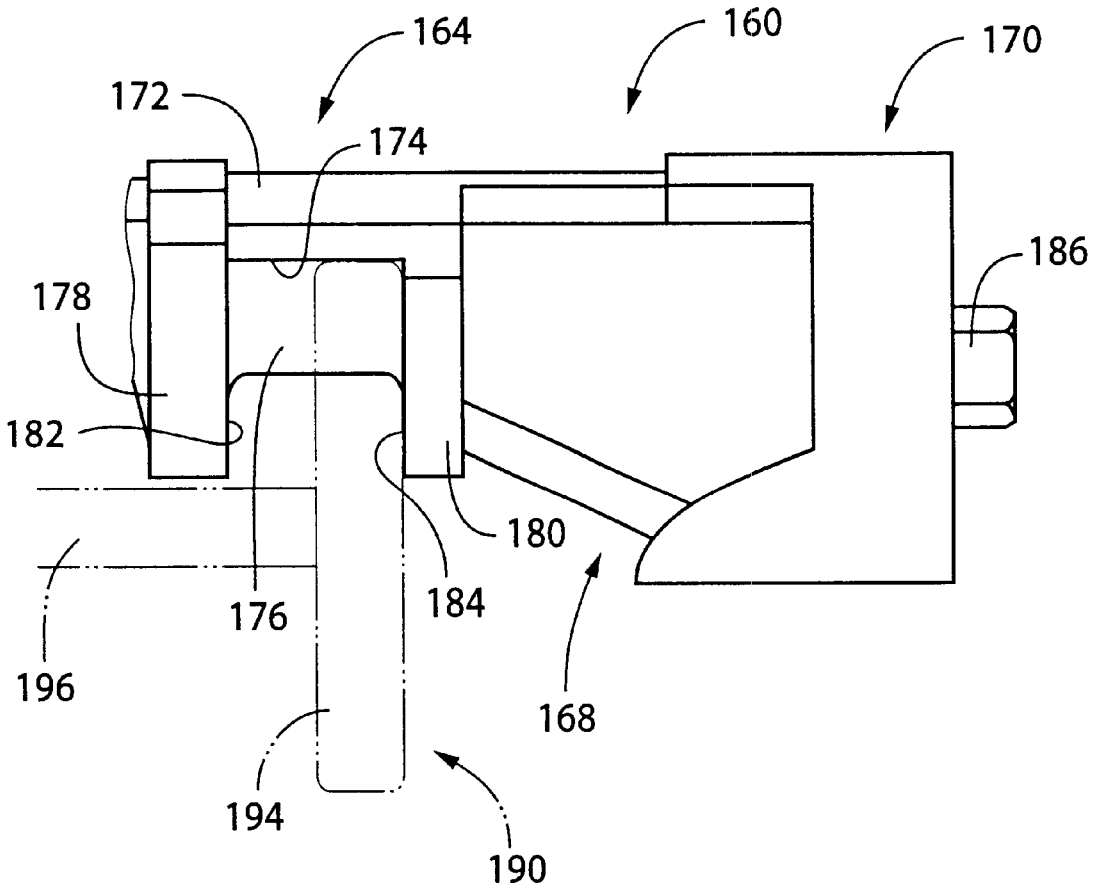
FIG. 5 is a front elevational view showing a part of the blank of FIG. 4 while it is subjected to a machining operation with a cutting tool.

Subsequently, the twin neck portion 166 is subjected to a machining operation, to remove the ribs 176 of the two neck portions 164, using a cutting tool 190 indicated by two-dot chain lines in FIGS. 5 and 6. The cutting tool 190 includes a body 194 and a shank 196. The body 194 has a peripheral cutting edge formed on its outer circumferential surface, and side cutting edges formed along the peripheries of the opposite side surfaces. The cutting tool 190 is rotated by a spindle of a suitable machine tool (e.g., a milling machine), with the shank 196 removably fitted in the bore of the spindle. The cutting tool 190, which may be a milling cutter, is capable of performing both a peripheral cutting operation with the peripheral cutting edge and a side cutting operation with the side cutting edges, with the rotating body 194 being moved in the radial direction relative to the rib 176. It will be understood that a difference between the radii of the body 194 and the shank 196 is made slightly larger than the distance of overhang or extension of the arm sections 178, 180 from the inner surface 174 of the base section 172, in order to prevent an interference between the shank 196 and the distal end portions of the arm sections 178, 180, during the cutting operation with the body 194. To form the fillets between the inner surface 142 of the base section 140 and the inner surfaces 148, 150 of the arm sections 144, 146 of the neck portion 80 of the piston 14, there are formed fillets between the opposite ends of the machined inner surface 174 of the base section 172 and the adjacent ends of the machined inner surfaces 182, 184 of the arm sections 178, 180. To this end, the body 194 is rounded with a suitable radius of curvature at the opposite ends of the peripheral cutting edge so that the peripheral cutting edge is smoothly connected to the side cutting edges through curved cutting edges, as indicated in FIG. 5. The fillets are effective to reduce the stress concentration at the boundaries between the inner surface 142 and the inner surfaces 148, 150. The stress concentration can be more or less reduced by chamfering the body 194 at the boundaries between the peripheral and side cutting edges.

Figure 6:
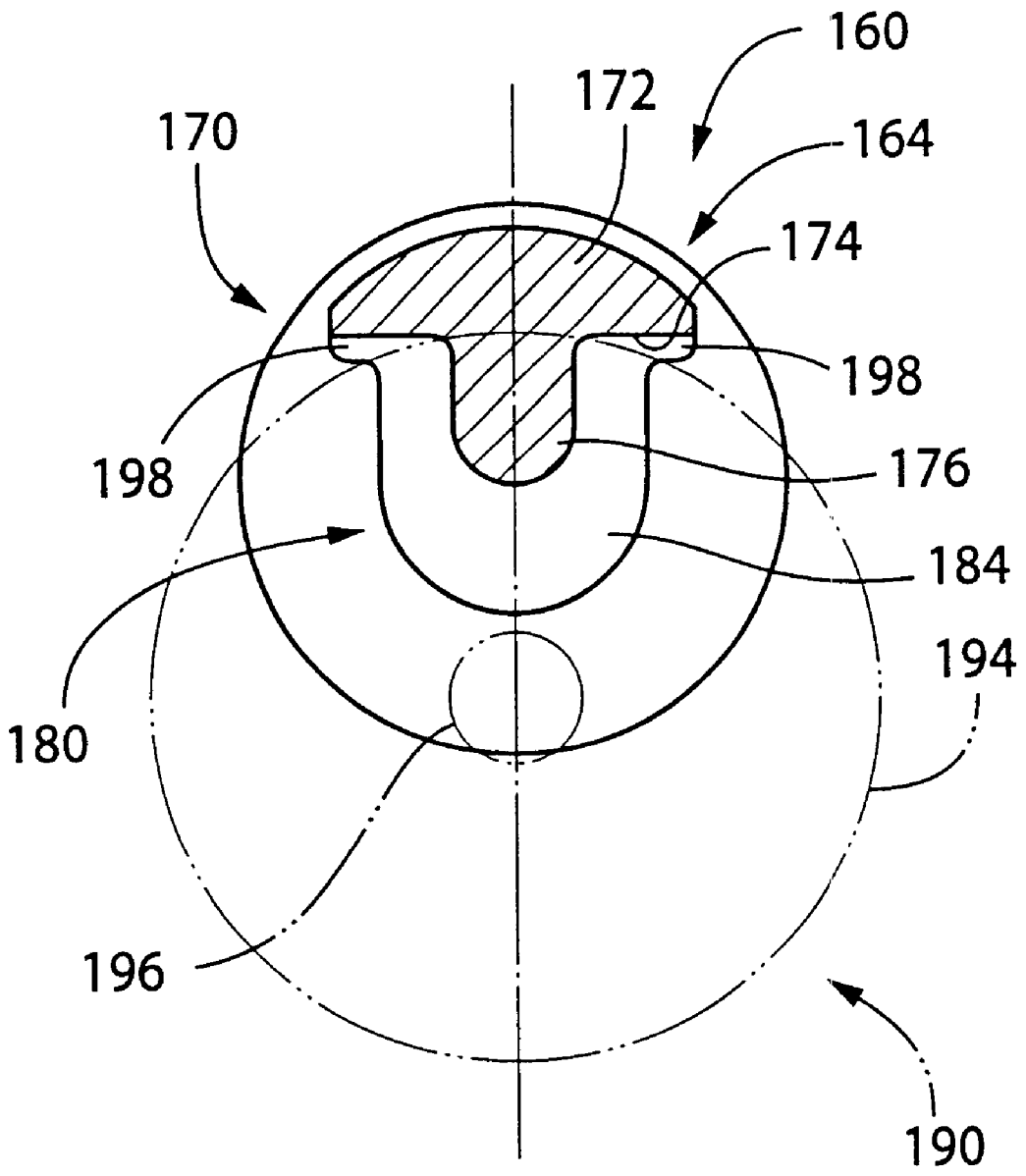
FIG. 6 is a cross sectional view taken along line 6-6 of FIG. 4.

Before the machining operation to remove the rib 176 with the cutting tool 190, the cutting tool 190 is positioned such that the axis of the tool 190 (shank 196) is parallel to the centerline of the head portions 170 and is aligned with the center of the rib 176 as viewed in the direction perpendicular to the plane of view of FIG. 5, namely, in the horizontal direction as seen in FIG. 6. Further, the cutting tool 190 is positioned in its axial direction such that one of the side cutting edges of the body 194 which is remote from the shank 196 is substantially aligned with the inner surface 184 of the arm section 180, as indicated in FIG. 5. The cutting tool 190 thus positioned is rotated about its axis and is fed in the radial direction toward the inner surface 174 (i.e., in the direction from the distal ends toward the proximal ends of the arm sections 178, 180). As a result, the end portion of the rib 176 adjacent to the arm section 180 is removed with the peripheral cutting edge of the body 194, while at the same time the inner surface 184 is machined with the above-indicated one of the side cutting edges. The part-spherical recess 152 indicated above is subsequently cut in the machined inner surface 184. In the presence of the rounded or chamfered edge between the peripheral and side cutting edges, there is left an uncut area or fillet 198 between the adjacent ends of the inner surface 174 of the base section 172 and the inner surface 184 of the arm section 180, as indicated in FIG. 6.

Then, the cutting tool 190 is retracted in its radial direction away from the inner surface 174 of the base section 172 to the initial position, and is fed in the axial direction until the other side cutting edge of the body 194 which is nearer to the inner surface 182 of the arm section 178 is substantially aligned with the inner surface 182. The cutting tool 190 is then fed in the radial direction toward the inner surface 174, to remove the remaining portion of the rib 176 and cut the inner surface 182, in the same manner as described above. In this case, too, a fillet 198 is left between the adjacent ends of the inner surface 174 and the inner surface 182.

The cutting operation with the cutting tool 190 is performed such that only the rib 176 is removed, without cutting any part of the inner surface 174 on which the rib 176 is not formed on the blank 160 before the cutting operation. As a result of removal of the rib 176, the inner surface 142 of the base section of the piston 14 produced from the blank 160 has the central machined surface area 154 extending in the direction of the centerline N, and the two as-cast surface areas 156 on the opposite sides of the machined surface area 154, as indicated in FIG. 3 and as described above. The as-cast surface areas 154 are provided by chilled layers having comparatively high degrees of hardness and strength, which are obtained by die-casting and which contribute to significant increase in the bending strength and durability of the base section 140 of the piston 14. It is also noted that the fillets 198 between the adjacent ends of the inner surfaces 174, 182, 184 of the base and arm sections 172, 178, 180 are left uncut so as to provide as-cast surface areas, which contribute to a significant increase in the durability of the neck portion 80 of the piston 14. The fillets 198 are located at the portions of the neck portion 80 at which the stress concentration is likely to occur.

The step of removing the ribs 176 from the blank 160 is followed by a step of forming the part-spherical recesses 152 in the machined inner surfaces 180 and 182 of the arm sections 178, 180, and a step of cutting the blank 160 into two pieces, at a midpoint intermediate between the adjacent arm sections 178 of the two neck portions 164, to thereby provide the two pistons 14.

The present embodiment of the invention assures improved durability of the piston 14 produced by die-casting, more particularly, a sufficiently high degree of durability of the neck portion 80, although the piston 14 is configured and designed so as to reduce its weight.

While the body 194 of the cutting tool 190 used in the present embodiment has an axial dimension smaller than the dimension of the groove 84 of the piston as measured in the direction parallel to the centerline N, the body 194 may have a dimension equal to the dimension of the groove 84. In this case, the rib 176 may be removed without moving the cutting tool 190 in the axial direction. It is also noted that the body 194 need not have the side cutting edges.

Figure 7:
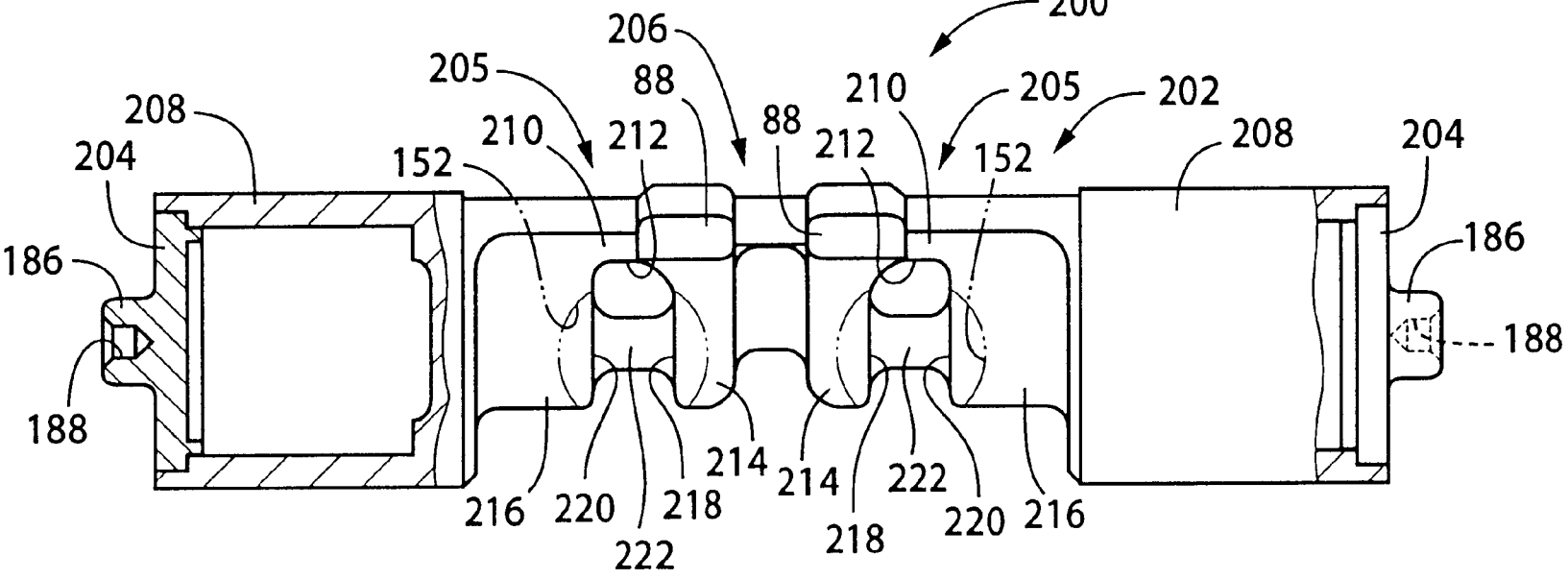
FIG. 7 is a front elevational view partly in cross section of a blank used for producing a piston according to a second embodiment of this invention.

Referring next to FIG. 7, there will be described a second embodiment of this invention wherein a blank 200 is used to produce two pieces of a single-headed pistons for a swash plate type compressor, which piston has a single hollow cylindrical head portion.

The blank 200 consists of a body member 202 and a pair of closure members 204. The body member 202 consists of a single twin neck portion 206, and two hollow cylindrical head sections 208 formed integrally with the twin neck portion 206 such that the two hollow cylindrical head sections 208 extend from the opposite ends of the twin neck portion 206. The twin neck portion 206 consists of mutually integrally formed two neck portions 205 which provide neck portions of the two pistons. Like the neck portions 164 of the blank 160, each of the neck portions 205 includes a base section 210 and a pair of parallel arm sections 214, 216 extending from an inner surface 212 of the base section 210. The arm sections 214, 216 have respective inner surfaces 218, 220 which cooperate with the inner surface of the base section 210 to define a generally U-shaped structure. The neck portion 205 further includes a reinforcing rib in the form of a bridge section 222 connecting the opposed inner surfaces 218, 220 of the arm sections 214, 216 such that the bridge section 222 is spaced from the inner surface 212. The body member 202 and the closure members 204 are formed by die-casting. In the blank 200 as shown in FIG. 7, the closure members 204 are fixedly fitted in the open end portions of the respective head sections 208, by suitable fixing means such as beam welding. In the present second embodiment, the same reference numerals as used in FIGS. 1–6 are used to identify the structurally similar or functionally corresponding elements.

The bridge section 222 of each neck portion 205 of the twin neck portion 206 of the blank 200 is removed by the cutting tool 190, in the same manner as described above with respect to the first embodiment. Then, casting fins formed on the central portion of the inner surface 212 of the base section 210 are removed by the cutting tool 190. In this second embodiment, too, two mold halves used to die-cast the blank 200 define a parting plane which includes the centerline of the hollow cylindrical head sections 208 and which is parallel to the direction of extension of the arm sections 214, 216. When the die-cast blank 200 is removed from the mold halves, small fins are formed in the generally elongate central portion of the inner surface 212 which extends in the direction of the centerline. In this embodiment, too, only the elongate central portion of the inner surface 212 of the base section 210 is machined to remove the fins, and the two portions of the inner surface 212 on the opposite sides of the central portion as well as the fillets between the inner surface 212 and the inner surfaces 218, 220 of the arm sections 214, 216 are left as-cast, so that the pistons obtained from the blank 200 has a high degree of durability at the base section 210 of their neck portions.

While the central part of the inner surface 142, 212 of the base section 140, 210 and the fillets 198 are left as-cast in the illustrated embodiments, only the central part of the inner surface 142, 212 may be left as-cast, or any desired portions other than the inner surface 142, 212 and fillets 198 may be left as-cast, in order to increase the strength or wear resistance of those other portions. Those other portions may include the outer surface of the base section 140, 210, and the surface of the rotation preventing part 88.

Further, the piston according to the present invention may be configured otherwise. For instance, the present invention is equally applicable to a double-headed piston having two head portions on the opposite sides of the neck portion.

It is to be understood that the present invention may be embodied with various other changes, modifications and improvements such as those described above in the SUMMARY OF THE INVENTION, which may occur to those skilled in the art, without departing from the spirit and scope of the invention defined in the following claims.

What is claimed is:

1. A die-cast piston for use in a swash plate compressor including a cylinder block having a cylinder bore formed therein, said piston comprising a generally cylindrical head portion capable of being slidably received in said cylinder bore, and a generally U-shaped neck portion having a base section and a pair of substantially parallel arm sections which extend from said base section, wherein said base section has an inner surface including at least one as-cast surface area formed in a die-casting process.

2. A die-cast piston according to claim 1, wherein said inner surface includes a central machined surface area and a pair of as-cast surface areas, said central machined surface area being located at an intermediate portion of said inner surface as viewed in a direction perpendicular to a centerline of the piston which passes a center of said generally cylindrical head portion, said central machined surface area being formed as a result of a machining operation in said intermediate portion of said inner surface, and wherein said pair of as-cast surface areas are located on opposite sides of said central machined surface area as viewed in said direction.

3. A die-cast piston according to claim 1, wherein a substantially entire portion of said inner surface is an as-cast surface area.

4. A die-cast piston according to claim 1, wherein said pair of arm sections have opposed inner surfaces having as-cast surface areas adjacent to said at least one as-cast surface area, said as-cast areas of said arm sections being also formed in said die-casting process.

5. A die-cast piston according to claim 1, wherein said head portion includes a body section having a circular shape in transverse cross section and cooperating with said cylinder bore to partially define a pressurizing chamber, said piston further comprising a connecting portion which connects said head portion and said neck portion.

6. A die-cast piston according to claim 5, wherein said head portion further includes a sliding section extending from said body section and connecting said body section and said connecting portion.

7. A die-case piston according to claim 1, wherein as-cast surface areas are formed at the boundary between the opposed inner surfaces of the arm sections and the inner surface of the base section.

8. A method of producing a die-cast piston for use in a swash plate compressor including a cylinder block having a cylinder bore formed therein, said die-cast piston comprising a generally cylindrical head portion capable of being slidably received in said cylinder bore, and a generally U-shaped neck portion having a base section and a pair of substantially parallel arm sections which extend from said base section, said method comprising the steps of:

forming a blank by die casting such that said blank includes: a head portion which gives said head portion of said piston; a neck portion which gives said neck portion of said piston and which includes a base section and a pair of arm sections; and a reinforcing portion which extends so as to connect said pair of arm sections of said neck portion of said blank, in a direction parallel to a centerline of said blank which passes a center of said head portion of the blank; and subjecting said blank to a machining operation to remove said reinforcing portion such that said base section of said neck portion of said blank has an inner surface including at least one as-cast surface area which is left unmachined.

9. A method according to claim 8, wherein said reinforcing portion is a rib extending from a central portion of said inner surface of said base section of said blank in a direction of extension of said pair of arm sections of said blank, said central portion being located at an intermediate portion of the inner surface of the base section of said blank as viewed in a direction perpendicular to said centerline, said rib connecting said base section and pair of arm sections of said blank, and wherein said step of subjecting said blank to a machining operation comprises removing said rib such that said inner surface of said base section of said blank includes a central machined surface area and a pair of as-cast surface areas located on the opposite sides of said central machined surface area as viewed in the direction perpendicular to said centerline.

10. A method according to claim 8, wherein said reinforcing portion is a bridge portion extending to connect said pair of arm sections of said blank in the direction parallel to said centerline, said bridge portion being spaced apart from said inner surface of said base section of said blank, and wherein said central portion is located at an intermediate portion of the inner surface of the base section of said blank as viewed in a direction perpendicular to said centerline, and wherein said step of subjecting said blank to a machining operation comprises removing said bridge portion and machining a central portion of said inner surface of said base section of said blank to remove fins formed in said step of forming a blank, such that said inner surface of said base section of aid blank includes a central machined surface area and a pair of as-cast surface areas located on the opposite sides of said central machined surface area as viewed in the direction perpendicular to said centerline.

11. A method according to claim 9, wherein said step of subjecting said blank to a machining operation comprises:

positioning a rotary cutting tool having a peripheral cutting edge such that said rotary cutting tool is rotatable about an axis which is parallel to said centerline and which is aligned with a center of said rib as viewed in the direction perpendicular to said centerline;

feeding said rotary cutting tool in a radial direction thereof toward said inner surface of said base section of said neck portion of said blank while said rotary cutting tool is rotated, so that said rib connecting said base section and said pair of arm sections of said blank is removed.

12. A method according to claim 8, wherein said pair of arm sections of said neck portion of said blank have respective opposed inner surfaces which are opposed to each other in the direction parallel to said centerline, and said rotary cutting edge further has side cutting edges formed on opposite sides of said peripheral cutting edge, and wherein said machining operation comprises machining at least a portion of each of said opposed inner surfaces such that an end portion of said each of said opposed inner surfaces which is adjacent to said inner surface of said base section of said blank is left as an as-cast surface area.

13. A method according to claim 10, wherein said step of subjecting said blank to a machining operation comprises:

positioning a rotary cutting tool having a peripheral cutting edge such that said rotary cutting tool is rotatable about an axis which is parallel to said centerline and which is aligned with a center of said bridge portion as viewed in the direction perpendicular to said centerline;

feeding said rotary cutting tool in a radial direction thereof toward said inner surface of said base section of said neck portion of said blank while said rotary cutting tool is rotated, so that said bridge portion connecting said pair of arm sections of said blank in the direction parallel to said centerline and said fins formed in said step of forming a blank are removed.

14. A die-cast piston for use in a swash plate compressor including a cylinder block having a cylinder bore formed therein, said piston comprising a generally cylindrical head portion capable of being slidably received in said cylinder bore, and a generally U-shaped neck portion having a base section and a pair of substantially parallel arm sections which extend from said base section, wherein said base section has an inner surface including a machined surface area and at least one as-cast surface area formed in a die-casting process.

15. A method of producing a die-cast piston for use in a swash plate compressor including a cylinder block having a cylinder bore formed therein, said die-cast piston comprising a generally cylindrical head portion capable of being slidably received in said cylinder bore, and a generally U-shaped neck portion having a base section and a pair of substantially parallel arm sections which extend from said base section, said method comprising the steps of:

forming a blank by die casting such that said blank includes: a head portion which gives said head portion of said piston; a neck portion which gives said neck portion of said piston and which includes a base section and a pair of arm sections; and a reinforcing portion which extends so as to connect said pair of arm sections of said neck portion of said blank, in a direction parallel to a centerline of said blank which passes a center of said head portion of the blank; and subjecting said blank to a machining operation to remove said reinforcing portion such that said base section of said neck portion of said blank has an inner surface including a machined surface area and at least one as-cast surface area which is left unmachined.

* * * * *